US005230476A

United States Patent [19]

Rust et al.

[11] Patent Number: 5,230,476

[45] Date of Patent: Jul. 27, 1993

[54] VERTICAL GRINDING AND MIXING TOWER

[76] Inventors: Marcus Rust, R.R. 5, Box 668, Seymour, Ind. 47294; Jeff Wilson, P.O. Box 45, Brook, Ind. 47922

[21] Appl. No.: 708,728

[22] Filed: May 31, 1991

[51] Int. Cl.[5] ..... B02C 23/08

[52] U.S. Cl. ..... 241/101.6; 366/91; 366/178

[58] Field of Search ..... 241/101 B, 101.3, 101.6; 366/91, 178; 222/132

[56] References Cited

U.S. PATENT DOCUMENTS

| | | | |
|---|---|---|---|
| 2,217,568 | 10/1940 | Shirley | 241/101.6 |
| 3,173,582 | 3/1965 | Walter | 222/132 |
| 3,182,919 | 5/1965 | Geerlings | 241/101.6 |
| 3,200,867 | 8/1965 | Stephan | 241/101.6 |
| 3,822,056 | 7/1974 | Hawes, Jr. et al. | 259/25 |

FOREIGN PATENT DOCUMENTS

| | | | |
|---|---|---|---|
| 236154 | 8/1925 | United Kingdom | 366/178 |

OTHER PUBLICATIONS

Feed and Grain Times, Showcase 1991, Jan. 1991, Johnson Hill Press.

*Primary Examiner*—Mark Rosenbaum
*Assistant Examiner*—John M. Husar
*Attorney, Agent, or Firm*—Baker & Daniels

[57] ABSTRACT

A portable feed mill system consists of a housing containing a primary constituent tank, a mill positioned to receive output from the primary constituent tank and a mixer. The mixer is positioned to receive the output from the mill and also a secondary feed constituent tank. Because the system is contained in a single housing, it may be remotely manufactured and transported to its final location at a cost far less than the cost of a conventional feed mill.

22 Claims, 4 Drawing Sheets

VERTICAL GRINDING AND MIXING TOWER

FIELD OF THE INVENTION

This invention relates to agricultural systems for grinding and mixing measured quantities of feed constituents to form a uniform mixture.

BACKGROUND OF THE INVENTION

Many of today's feed mills are relatively large structures capable of yielding large quantities of feed from a number of feed constituents. These large-capacity feed mills usually include several large storage tanks, a grinder, a mixer, and a control system. An example of a feed mill used to mix a number of feed constituents is shown in U.S. Pat. No. 3,822,056, in which the control system permits for the mixing of accurately measured quantities of macro-ingredients and micro-ingredients, both liquid and dry.

The use of a common grinder and mixer for all feed constituents in a large-capacity feed mill provides a great deal of flexibility in the types of constituents that can be ground and mixed by the system, even though, in many instances, only a primary constituent, such as corn, needs to be ground before it is mixed with the other constituents. Therefore, the flexibility of the large-capacity feed mill results in a configuration which requires power to transfer the constituents over long distances to the mill and mixer and which covers a large geographic area. For example, separate feed constituents are normally stored in individual feed towers having inlets at the top of the towers and outlets at the bottom of the towers. To mix feed constituents, each constituent must be elevated and transferred to a separate mixer located in another tower. Thus, significant expense is incurred in constructing and maintaining separate towers to house the feed constituents and the mixer, and in providing and operating augers to elevate the contents of each feed tower and transfer them to the mixer.

As a result, feed mills are usually owned and operated only by large agricultural cooperatives or very large individual farm operators that use a large volume of feed. The expense of these systems is, in part, caused by the need to completely construct the mill at the site. Thus, the construction and maintenance costs of present feed mills are prohibitively high for an individual farmer or a small agricultural cooperative that only needs moderate amounts of feed.

OBJECTS OF THE INVENTION

One object of the present invention is to provide a feed mill that is inexpensive, easy to manufacture and capable of mixing the same types of constituents that can e mixed with large-capacity feed mills without requiring a great deal of square footage at the installation site.

Another object of the present invention to provide an agricultural feed mill system that can be transported as a single unit from a manufacturing facility to the installation site and, therefore, is easy, quick an inexpensive to install.

It is still another object of the present invention to minimize the amount of energy required to transfer feed constituents while producing mixed feed.

SUMMARY OF THE INVENTION

The invention comprises a portable feed mill system having a housing containing a primary constituent tank, a mill positioned to receive output from the primary constituent tank and a mixer. The mixer is positioned to receive the output from the mill and also at least one secondary feed constituent from either an integral or an external secondary feed constituent tank. Because the system is contained in a single housing, it may be remotely manufactured and transported to its final location at a cost far less than the cost of a conventional feed mill.

DETAILED DESCRIPTION

Figure 1:
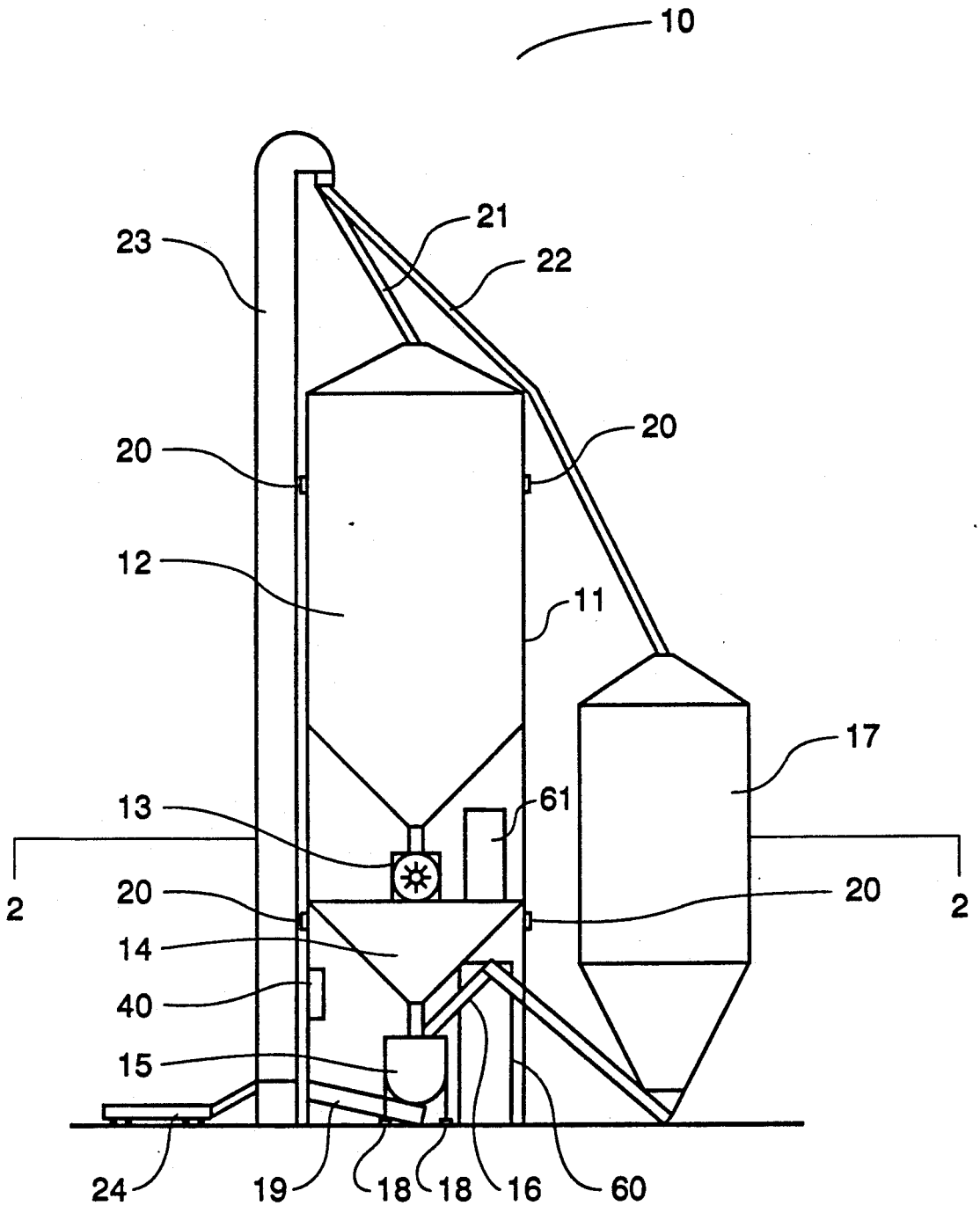
FIG. 1 shows a vertical cross-sectional view of one embodiment of the present invention.

Referring to FIG. 1, there is shown a vertical cross-sectional diagrammatic view of a feed mill system in accordance with the present invention. Feed mill system 10 is capable of grinding feed constituents with mill 13 and mixing several feed constituents with mixer 15 to produce a desired mixed feed. Feed mill system 10 consists of common portable housing 11 to which attachment means, such as brackets 20, are affixed to allow common housing 11 and its contents to be moved or lifted as a single unit and transported to the installation site. Access doors 61, 60 provide access through housing 11 to mill 13, available from Jacobson Manufacturing, and mixer 15, available from scott Equipment Co. Primary constituent tank 12 may be filled with a primary feed constituent, such as corn, which is to be ground before it is mixed with other feed constituents to yield the desired feed mixture. Secondary constituent tank(s) 17 are each filled with a secondary feed constituent, such as oats, soybean meal or salt, which are mixed with the ground primary feed constituent. Hopper 14 provides means for transferring the primary constituent from mill 13 to mixer 15, and chute 16 provides means for introducing at least one secondary constituent to mixer 15. Primary constituent tank 12, mill 13, primary constituent or batching hopper 14 and mixer 15 are all affixed to and located in common housing 11 and positioned such that gravitational forces alone are capable of causing a primary constituent to move from primary constituent tank 12, through mill 13, through primary constituent hopper 14 and through mixer 15.

Bucket elevator 23 (available from Riley Equipment Corp.), and loading augers 21, 22 provide means for loading primary and secondary constituent tanks 12 and 17 with feed constituents. Conveyor 19 provides receives and conveys the output of mixer 15. Any or all of the components of loading means 21, 22, 23 may optionally be attached to common housing 11.

Digital scale load cells 18, available from Hardy Instruments, are positioned below mixer 15 such that scale load cells 18 measure the weight of the primary and secondary constituents in mixer 15 together with mixer 15. Computer control panel 40, available from Wilson Design Builders, Inc., located on the inside wall of housing 11, is connected to scale load cells 18, hopper slide gates and augers throughout the system, and controls the amount of the primary and secondary constituents introduced to mixer 15 to produce the mixed feed.

During the operation of feed mill system 10, a primary constituent within primary constituent tank 12 moves into mill 13 where it is ground. The ground primary constituent then moves through primary constituent hopper 14 toward mixer 15. Secondary constituent(s) from secondary tank(s) 17 move through chute 16 to join the ground primary constituent in mixer 15. It will be appreciated that computer control of the type well-known in the art is used to control the amount of primary constituent introduced into mill 13, the amounts of ground primary constituent and secondary constituents introduced to mixer 15, and the mixing time. It will be further appreciated that a primary constituent can be ground in mill 13 while ground primary constituent and secondary constituents are mixed in mixer 15.

Figure 2:
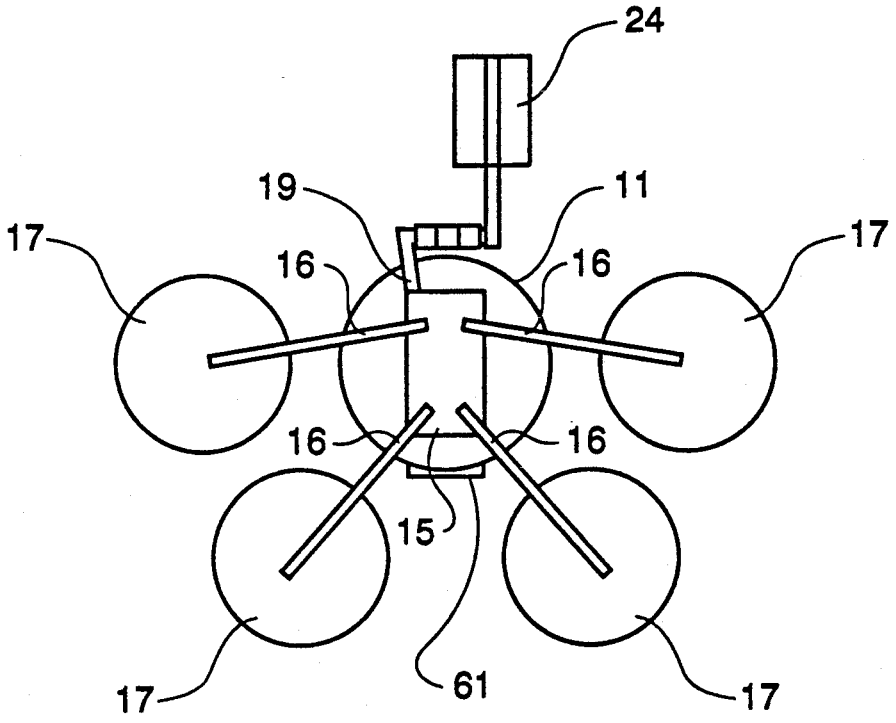
FIG. 2 shows a horizontal cross-sectional view of the embodiment shown in FIG. 1.

FIG. 2 shows a horizontal cross-sectional view of the feed mill system illustrated in FIG. 1 which utilized four (4) external secondary constituent tanks 17. In one embodiment, chutes 16 introduce a secondary constituent to mixer 15 and are radially positioned with respect to the center of mixer 15. Chutes are provided above the mixer, so that once the secondary feed constituents enter housing 11, the force of gravity alone causes the secondary feed constituents to move toward mixer 15.

Figure 3:
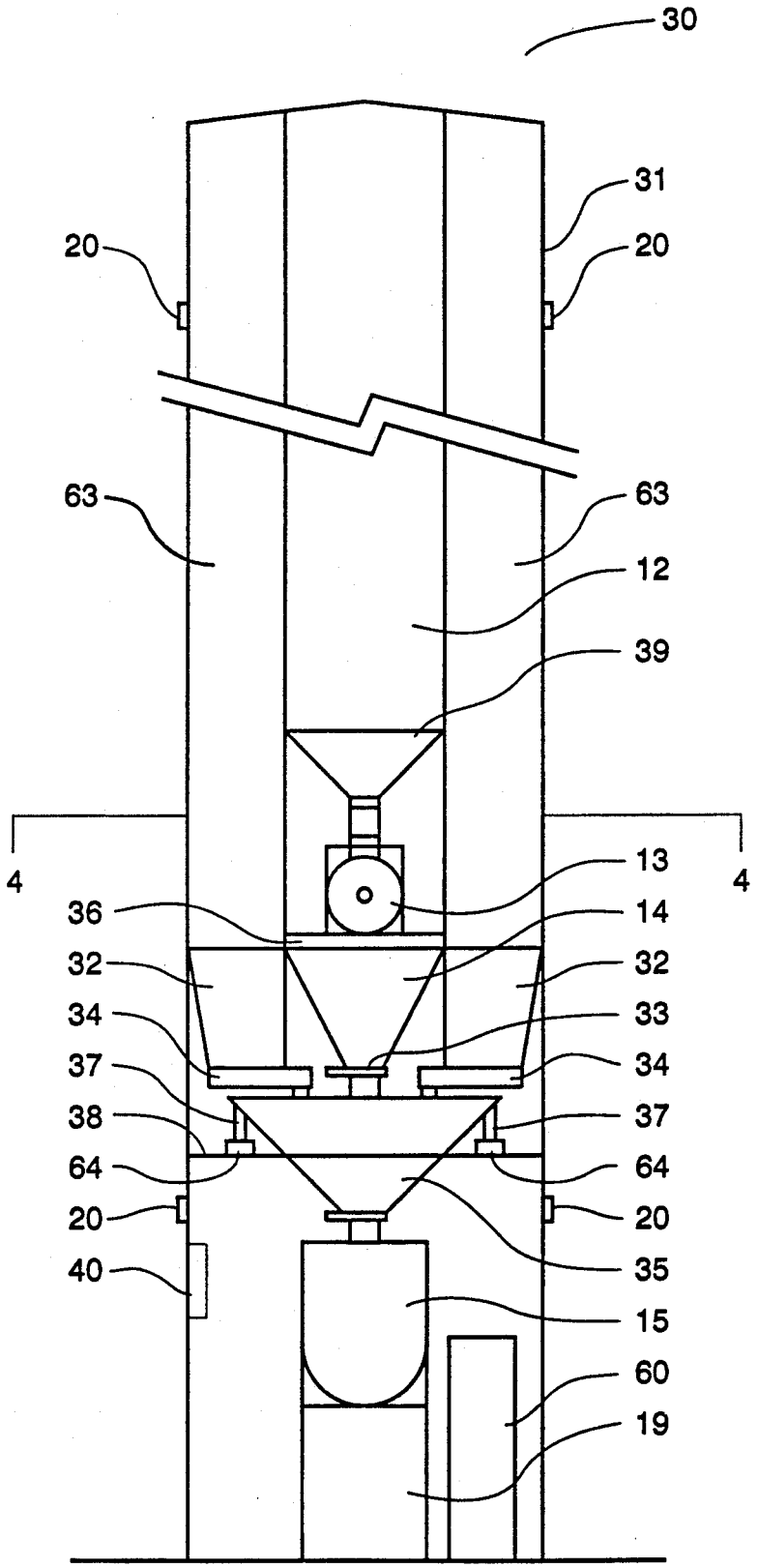
FIG. 3 shows a vertical cross-sectional view of another embodiment of the present invention in which all components of the feed mill are enclosed in a common portable housing.

FIG. 3 shows a vertical cross-sectional diagrammatic view of another embodiment of the present invention in which feed mill systems 30 consists of common portable housing 31 to which brackets 20 are affixed to permit common housing 31 and its contents to be moved and lifted as a single unit. Primary constituent tank 12, secondary constituent tank(s) 63, mill 13, primary constituent hopper 14, secondary constituent hopper(s) 32, batching hopper 35, and mixer 15 are contained in common housing 31. Primary constituent tank 12 is centered in common housing 31, secondary constituent tank(s) 63 are located between primary constituent tank 12 and the exterior of common housing 31, and primary constituent tank 12 and secondary constituent tank(s) 63 share a common wall. Furthermore, secondary constituent tank(s) 63, secondary constituent hopper(s) 32, and mixer 15 are positioned such that gravitational forces alone are capable of causing a secondary constituent to move from secondary constituent tank 63, through secondary constituent hopper 32 and batching hopper 35, and into mixer 15.

Batching hopper 35 is supported from crossbar 38 by four support arms 37, each of which includes a digital scale load cell 64 connected to computer control 40 to weigh the primary and secondary constituents together with batching hopper 35. Feeder screws 34, available from Screw Conveyor Corp., assist in the controlled transfer of the secondary feed constituent between secondary constituent hoppers 32 and batching hopper 35. Feeder screws 34 and slide gate 33 may be controlled manually, such as with levers (not shown), or automatically, such as with the assistance of a computer control system as is illustrated by control panel 40. It will be appreciated that other types of equipment, such as a bin vibrator, can be used in place of feeder screws 34. Additionally, conveyor means 19 may be placed below the mixer (as shown in FIG. 1) to receive and convey mixed feed output of the mixer, and a bucket elevator, similar to bucket elevator 23 shown in FIG. 1, may be used for loading feed constituents into primary 12 and secondary 63 constituent tanks or for moving mixed feed to a storage tank (not shown). The means provided for loading feed constituents may optionally be attached to common housing 31 such that the amount of construction required at the installation site is reduced.

During the operation of feed mill system 30, a primary constituent from primary constituent tank 12 enters mill 13 though hopper 39. The ground primary constituent then moves through primary constituent hopper 14 and past slide gate 33 into batching hopper 35. A secondary constituent moves from secondary constituent tank 63, through secondary constituent hopper 32 and feeder screw 34 into batching hopper 35. The primary and each secondary feed constituent may be separately transported to batching hopper 35, so that the amount of each constituent may be separately weighed. After the proper weight of each constituent has been combined in batching hopper 35, slide gate 70 of batching hopper 35 is opened to cause the constituents to enter mixer 15, where they are mixed. While mixing, another batch of feed constituents may be measured into batching hopper 35. It will be appreciated that computer control system 40 may be programmed to control the amount of primary constituent that enters mill 13 and the amount of ground primary constituent and secondary constituents that enter batching hopper 35.

Figure 4:
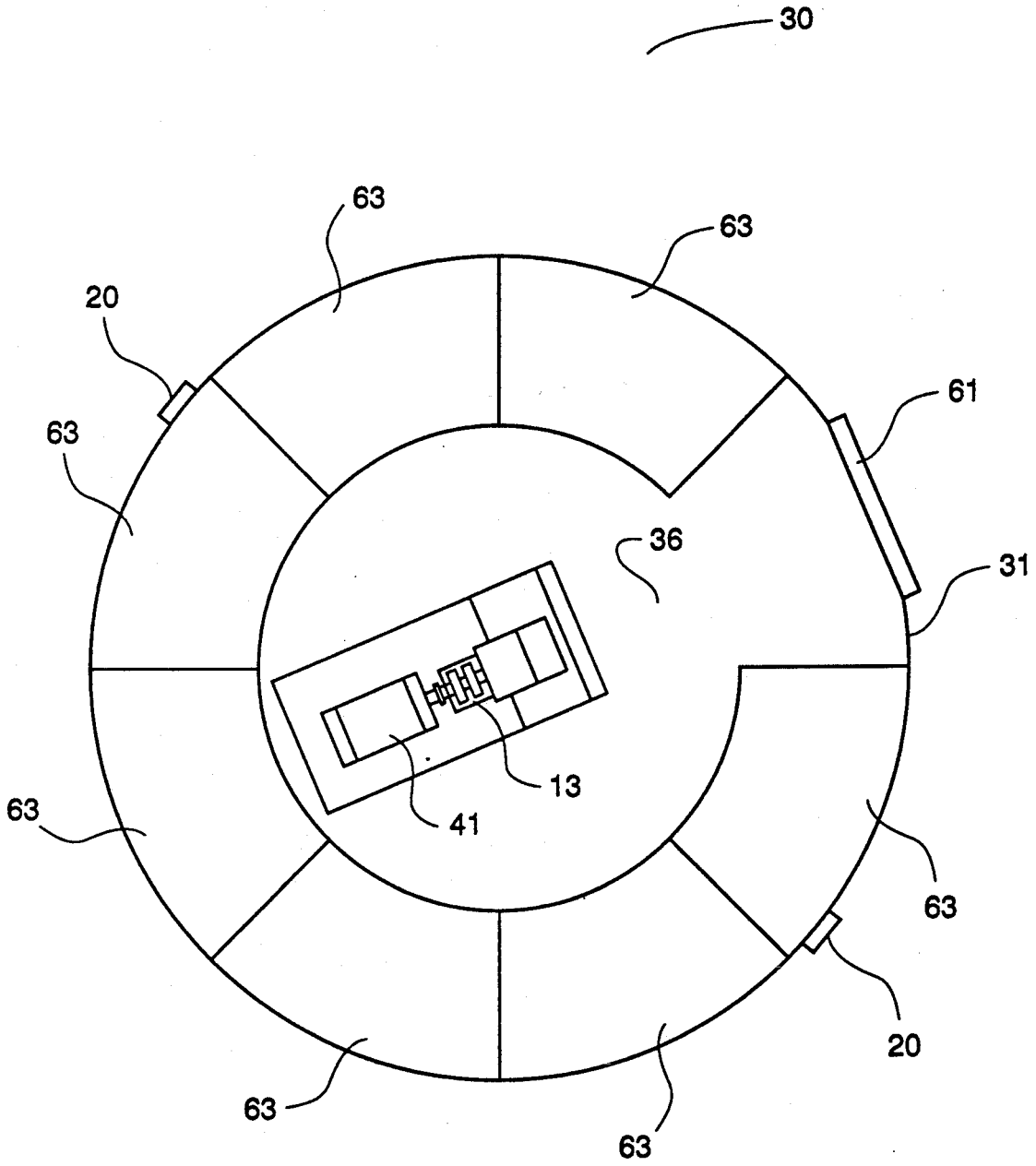
FIG. 4 shows a horizontal cross-sectional view of the embodiment shown in FIG. 3.

FIG. 4 shows a horizontal cross-sectional view of the feed mill system 30 illustrated in FIG. 3 which utilizes several secondary constituent tanks 63. Shown in the center of housing 31 is mixer 15 powered by mixer motor 41. Primary constituent tank 12 is centered in common housing 31 and secondary constituent tanks 63 are located between primary constituent tank 12 and the outside of common housing 31. Lower access door 60 is provided to allow entry into common housing 31, and upper access door 61 provides entry to service platform 36. Primary 14 and secondary 32 constituent hoppers, primary and secondary constituent tanks 12 and 63, and batching hopper 35 are all available from Peabody Tec-Tank.

The common housing for the two embodiments disclosed herein may be approximately fourteen (14) feet in diameter and seventy (70) feet tall, This size allows for convenient transport to the installation location following the manufacture of the system.

It will be appreciated by those of skill in the art that because the entire feed mill system disclosed herein is contained in a single housing, the system may be manufactured at a factory and then transported to the installation site. Factory assembly results in a much lower cost for the system when compared to conventional feed mills which are usually much larger and constructed at the installation site. Moreover, because all feed constituent tanks may be combined into a single unit, the system occupies much less square footage than a conventional mill. In addition, the vertical arrangement of the various components of the system allow the force of gravity alone to move the constituents through the system, thus eliminating the energy costs associated with conventional systems to lift the feed constituents to different towers for processing.

We claim:

1. A feed mill system comprising:

a primary constituent tank;

a mill structurally aligned with said primary constituent tank to receive output therefrom;

a mixer;

means for transferring milled primary constituent from the mill to the mixer;

at least one secondary constituent tank; and means for introducing non-milled secondary constituent to the mixer; in which the primary constituent tank, the mill, the mixer, the milled primary constituent transferring means, the secondary constituent tank, and the non-milled secondary constituent introducing means are all located in a common portable housing, wherein the primary constituent tank is positioned in a central portion of the housing, and the secondary constituent tank is positioned intermediate the primary constituent tank and the exterior of the housing.

2. The feed mill system of claim 1 wherein the primary constituent tank, the mill, the means for transferring the primary constituent to the mixer, and the mixer are positioned such that gravitational forces are capable of causing a primary constituent to move from the primary constituent tank, through the mill, through the means for transferring the primary constituent to the mixer and through the mixer.

3. The feed mill system of claim 1 wherein the secondary constituent tank, the means for introducing at least one secondary constituent to the mixer and the mixer are positioned such that gravitational forces alone are capable of causing a secondary constituent to move from the secondary constituent tank, through the means for introducing at least one secondary constituent to the mixer and into the mixer.

4. A feed mill system comprising:

a primary constituent tank;

a mill structurally aligned with said primary constituent tank to receive output from the primary constituent tank;

at least one secondary constituent tank;

batching hopper means oriented with respect to the mill to receive gravitationally forced milled output therefrom, and being oriented with respect to the secondary constituent tank to receive gravitationally forced non-milled output therefrom;

a mixer oriented with respect to the batching hopper means to receive gravitationally forced output from the batching hopper means; and a common portable housing for the primary and secondary constituent tanks, the mill, the batching hopper means and the mixer.

5. The feed mill system of claim 4 wherein the primary constituent tank and secondary constituent tanks share a common wall.

6. The feed mill system of claim 4 wherein the common housing includes an attachment means for lifting and moving the housing.

7. The feed mill system of claim 4 further comprising a conveyor means for receiving and conveying output of the mixer.

8. The feed mill system of claim 4 further comprising means attached to the common housing for loading primary and secondary constituent tanks with feed constituents.

9. The feed mill system of claim 4 further comprising means for controlling the amount of the primary and secondary constituents introduced to the mixer.

10. The feed mill system of claim 4 further comprising a scale capable of measuring the weight of the primary and secondary constituents introduced to the mixer.

11. The feed mill system of claim 10 wherein the batching hopper hangs from the scale.

12. The feed mill system of claim 10 further wherein the scale supports the mixer and is capable of measuring the weight of the primary and secondary constituents in the mixer together with the mixer.

13. A feed mill system comprising:

a primary constituent tank;

a mill structurally aligned with said primary constituent tank to receive output from the primary constituent tank;

batching hopper means oriented with respect to the mill to receive gravitationally forced milled output therefrom;

a mixer oriented with respect to the batching hopper means to receive gravitationally forced output from the batching hopper means;

means for introducing a non-milled secondary constituent to the mixer;

a common portable housing for the primary constituent tank, the mill, the non-milled secondary constituent introduction means, the batching hopper means and the mixer; and at least one secondary constituent tank located without the common portable housing and connected to the non-milled secondary constituent introduction means.

14. The feed mill system of claim 13 wherein the primary constituent tank, the mill, the batching hopper, and the mixer are positioned such that gravitational forces are capable of causing the primary constituent to move from the primary constituent tank, through the mill, through the batching hopper and through the mixer.

15. The feed mill system of claim 13 wherein the means for introducing at least one secondary constituent to the mixer is radially positioned with respect to the center of the mixer.

16. The feed mill system of claim 13 wherein the common housing includes an attachment means for lifting and moving the housing.

17. The feed mill system of claim 13 further comprising a scale positioned below the mixer such that the scale supports the mixer and is capable of measuring the weight of the primary and secondary constituents in the mixer together with the mixer.

18. The feed mill system of claim 13 further comprising a conveyor means for receiving and conveying output of the mixer.

19. The feed mill system of claim 13 further comprising means attached to the common housing for loading the primary constituent tank with a feed constituent.

20. The feed mill system of claim 13 further comprising means for controlling the amount of the primary and secondary constituents introduced to the mixer.

21. The feed mill system of claim 13 further comprising at least one secondary constituent tank located in the common portable housing and connected to the means for introducing at least one secondary constituent to the mixer.

22. A feed mill system comprising:

a primary constituent tank;

a mill structurally aligned with said primary constituent tank to receive output therefrom;

a mixer;

means for transferring a milled primary constituent from the mill to the mixer;

means for introducing a non-milled secondary constituent to the mixer; and at least one secondary constituent tank connected to the non-milled secondary constituent introducing means; in which the primary constituent tank, the mill, the mixer, the milled primary constituent transferring means, the secondary constituent tank, and the non-milled secondary constituent introducing means are all located in a common portable housing, wherein the primary constituent tank and the secondary constituent tank share a common wall.

* * * * *